US006739903B1

(12) United States Patent
Aoki et al.

(10) Patent No.: US 6,739,903 B1
(45) Date of Patent: May 25, 2004

(54) CONNECTOR STRUCTURE

(75) Inventors: Hiroshi Aoki, Shizuoka (JP); Takayoshi Endo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/649,012

(22) Filed: Aug. 28, 2000

(30) Foreign Application Priority Data

Aug. 27, 1999 (JP) ..... 11-241779

(51) Int. Cl.[7] ..... H01R 12/24
(52) U.S. Cl. ..... 439/496
(58) Field of Search ..... 493/67, 493, 492, 493/496, 455, 354, 329, 77

(56) References Cited

U.S. PATENT DOCUMENTS

| | | | | | |
|---|---|---|---|---|---|
| 3,084,302 | A | * | 4/1963 | Braeutigam | 439/327 |
| 3,602,870 | A | * | 8/1971 | Willard | 439/67 |
| 3,696,319 | A | | 10/1972 | Olsson | |
| 3,825,878 | A | * | 7/1974 | Finger et al. | 439/67 |
| 3,923,364 | A | | 12/1975 | Shapiro et al. | |
| 4,784,615 | A | | 11/1988 | Teng-Hong | 439/496 |
| 5,040,997 | A | | 8/1991 | Garner | |
| 5,080,595 | A | * | 1/1992 | Mouissie | 439/67 |
| 5,083,939 | A | | 1/1992 | Ittah | |
| 5,383,788 | A | * | 1/1995 | Spencer | 439/67 |
| 5,507,651 | A | * | 4/1996 | Tanaka et al. | 439/67 |
| 5,529,502 | A | * | 6/1996 | Peltier et al. | 439/67 |
| 6,086,412 | A | * | 7/2000 | Watt et al. | 439/496 |

FOREIGN PATENT DOCUMENTS

| | | | | |
|---|---|---|---|---|
| DE | 1 490 802 | | 5/1991 | |
| EP | 0 866 520 | A2 | 9/1988 | |
| EP | 0 427 615 | A1 | 11/1990 | H01R/9/07 |
| EP | 0427615 | * | 5/1991 | H01R/9/07 |
| EP | 0 782 215 | A1 | 7/1997 | |
| EP | 0 889 547 | A2 | 1/1999 | |
| EP | 0908975 | * | 4/1999 | H01R/23/66 |
| EP | 0 908 975 | A1 | 4/1999 | H01R/23/66 |
| JP | 9-97655 | | 4/1997 | H01R/23/68 |
| JP | 9-330772 | | 12/1997 | H01R/23/66 |

OTHER PUBLICATIONS

Abstract of Japan 09097655 Apr. 8, 1997.

Research Disclosure, Aug. 1986, p. 469, item 26837, "Flex circuit wrap connector" discloses pins on each side of a flat support retaining a circuit wrapped over the support.

* cited by examiner

*Primary Examiner*—Jean F. Duverne
(74) *Attorney, Agent, or Firm*—Sughrue Mion, PLLC

(57) ABSTRACT

In this connector structure, a conducting portion 4 of an FPC 1 is inserted into a connector housing 21, and conductors, exposed to the conducting portion 4, are electrically connected respectively to a plurality of connection terminals 25 received respectively in terminal receiving chambers 29. The conducting portion 4 of the FPC 1 is provisionally held on obverse and reverse surfaces of a flat plate portion 7 of a holder 5, which is to be fitted into the connector housing 21, in a folded-back manner, so that the conductors of the conducting portion 4 are arranged on the obverse and reverse surfaces of the flat plate portion 7. Electrical connection portions 26 of the connection terminals 25 grasp the conductors, disposed on the obverse and reverse surfaces of the flat plate portion, respectively, so that the FPC is electrically connected to the connection terminals 25.

11 Claims, 9 Drawing Sheets

CONNECTOR STRUCTURE

BACKGROUND OF THE INVENTION

1. Technical Field

This invention relates to a connector structure, and more particularly to a connector structure for connecting a connection end portion of a flat circuit member.

2. Related Art

Flat circuit members, such as a flexible printed circuit board (hereinafter referred to as "FPC"), formed by printing electrical conductors on an insulating film, and a flexible flat cable (hereinafter referred to as "FFC") formed by covering a plurality of parallel conductors with an insulating material, have heretofore been extensively used in a wire harness, designed to connect electric parts in an automobile, and various equipments such as a computer since such a flat circuit member can be installed in a narrow space because of its construction, and also can be provided on a moving part because of its flexible nature.

Such a flat circuit member itself has flexibility, and therefore when the flat circuit member is to be connected to a connector, its end portion must be formed into a rigid terminal.

Therefore, there has been proposed a cable fixing method (disclosed, for example, in Japanese Unexamined Patent Publication Hei. 9-330772) in which there is used a cable holder for holding a distal end portion of an FFC. With this method, a cumbersome operation, in which a distal end portion of a cable is gripped and is inserted into a mating connector, is eliminated, and besides the incomplete insertion of the FFC and the incomplete locking of the connector are eliminated.

As shown in FIG. 9, the cable holder 100 includes a main holder portion 101 defining a holder body, and an auxiliary holder portion 102, and a distal end portion of the FFC 103 is held or fixed by these portions 101 and 102.

An insulating film or coating, covering conductors, is removed a predetermined length from one side of the distal end portion of the FFC 103 so as to provide a conducting portion 109 serving as a connection end portion. A reinforcing plate 105 including a thin resin plate is bonded to the other side of the distal end portion of the FFC 103. The distal end portion of the FFC 103, to which the reinforcing plate 105 is bonded, serves as a reinforcing portion 104, and notches 106 of a channel-shaped cross-section are formed respectively in opposite side edges of the reinforcing portion 104.

A recess 110, equal in width to the FFC 103, is formed in the main holder portion 101. Projections 107 of an elongate, convex shape, conforming in cross-section to the notches 106 in the FFC 103, are formed respectively on opposite side walls of the recess 110.

The auxiliary holder portion 102 is pressed or pushed into the recess 110 in the main holder portion 101 from the front side, and is fixed to the main holder portion 101. Therefore, grooves 108 of a channel-shaped cross-section, corresponding respectively to the projections 107, are formed in opposite side surfaces of the auxiliary holder portion 102, respectively. In order to retain the auxiliary holder portion 102 against disengagement, thus pushed into the recess 110 from the front side, retaining claws 111 are formed on the main holder portion 101 whereas notches 112 are formed in the auxiliary holder portion 102.

For attaching the FFC 103 to the cable holder 100 of the above construction, the notches 106 in the FFC 103 are registered respectively with the projections 107 on the main holder portion 101, and then the FFC 103 is pressed toward the bottom of the recess 110. Then, the grooves 108 in the auxiliary holder portion 102 are registered with the projections 107, respectively, and then the auxiliary holder portion 102 is pushed hard toward the main holder portion 101.

Then, when the auxiliary holder portion 102 is further pushed, the retaining claws 111 are engaged respectively in the notches 112, with a gap, corresponding to the thickness of the reinforcing portion 104, formed between the auxiliary holder portion 102 and the bottom of the recess 110. Therefore, the auxiliary holder portion 102 is fixed to the main holder portion 101 by the retaining claws 111, and cooperates with the main holder portion 101 to hold the reinforcing portion 104 therebetween in a fixed manner. In this condition, a stepped inner surface of a lower portion of the main holder portion 101 and a stepped inner surface of a lower portion of the auxiliary holder portion 102 jointly form a holder guide portion defining a space corresponding to an outer shape of the mating connector (not shown).

The FFC 103, thus held by the holder main potion 101 and the auxiliary holder portion 102 with the distal end portion thereof projecting into the holder guide portion, is firmly held against movement in the length of the cable since the projections 107 are engaged in the notches 106, respectively.

In the cable holder 100 of the above construction, however, the reinforcing plate 105 must beforehand be bonded to the FFC 103 so as to form the reinforcing portion 104 at the distal end portion of the FFC 103. Therefore, there are encountered problems that the efficiency of the assembling operation is low and that the production cost increases.

And besides, the notches 106 are formed in the opposite side edges of the reinforcing portion 104, respectively, and therefore in the case where the flat circuit member is an FFC having a plurality of parallel conductors covered with an insulating material, the conductors can not be provided at the opposite side portions of the cable, thus inviting a problem that the percentage of utilization of the flat circuit member is low.

SUMMARY OF THE INVENTION

Therefore, an object of the invention is to overcome the above problems, and more specifically to provide a connector structure in which a connection end portion of a flexible flat circuit member is easily formed into a terminal so as to be connected to a connector, and besides even when the connection end portion is formed into the terminal, the percentage of utilization of the flat circuit member is prevented from being lowered, and the stable connection performance can be obtained.

The above object of the invention has been achieved by a connector structure wherein a connection end portion of a flexible flat circuit member is inserted into a terminal receiving chamber in a connector housing, and conductors, exposed to the connection end portion, are electrically connected respectively to a plurality of connection terminals received in the terminal receiving chamber; CHARACTERIZED in that:

the connection end portion of the flat circuit member is provisionally held on obverse and reverse surfaces of a flat plate portion of a holder, which is to be fitted into the connector housing, in a folded-back manner, so that the conductors, provided on the connection end portion at predetermined intervals in parallel relation to one another, are arranged on the obverse and reverse surfaces of the flat plate portion; and electrical connection portions of the connection terminals grasp the conductors, disposed on the obverse and reverse surfaces of the flat plate portion, respectively, so that the flat circuit member is electrically connected to the connection terminals.

In the above construction, the connection end portion of the flat circuit member, at which the conductors are exposed, is provisionally held on the flat plate portion of the holder in a folded-back manner, and then the holder is fitted into the connector housing, and merely by doing so, the conductors, disposed on the obverse and reverse surfaces of the flat plate portion, can be held respectively by the electrical connection portions of the connection terminals, received in the terminal receiving chamber, in a grasped manner, and therefore are electrically connected thereto.

Therefore, it is not necessary to bond a reinforcing plate to the connection end portion of the flat circuit member, and the efficiency of the assembling operation is enhanced. And besides, the connection end portion of the flat circuit member is held on the flat plate portion of the holder in a folded-back manner, and therefore can deal with a pulling force acting on the flat circuit member, so that the connection end portion is prevented from withdrawal.

Furthermore, the conductors on the connection end portion, held on the obverse and reverse surfaces of the flat plate portion of the holder in a folded-back manner, are electrically connected respectively to the electrical connection portions of the connection terminals in a grasped manner, and therefore each conductor contacts the associated connection terminal at two regions, so that the positive electrical connection can be achieved.

The above object of the invention has also been achieved by a connector structure wherein a connection end portion of a flexible flat circuit member is inserted into a terminal receiving chamber in a connector housing, and conductors, exposed to the connection end portion, are electrically connected respectively to a plurality of connection terminals received in the terminal receiving chamber; CHARACTERIZED in that:

the connection end portion of the flat circuit member is provisionally held on obverse and reverse surfaces of a flat plate portion of a holder, which is to be fitted into a holder casing which can be releasably inserted into the connector housing, in a folded-back manner, so that the conductors, provided on the connection end portion at predetermined intervals in parallel relation to one another, are arranged on the obverse and reverse surfaces of the flat plate portion;

the flat plate portion of the holder, having the connection end portion provisionally held on the obverse and reverse surfaces thereof, is passed through an insertion hole formed in the holder casing in which the holder is fitted; and electrical connection portions of the connection terminals grasp the conductors, disposed on the obverse and reverse surfaces of the flat plate portion passed through the insertion hole, respectively, so that the flat circuit member is electrically connected to the connection terminals.

In the above construction, the connection end portion of the flat circuit member, at which the conductors are exposed, is provisionally held on the flat plate portion of the holder in a folded-back manner, and then the holder is fitted into the holder casing, and then the holder casing, receiving the holder, is inserted into the connector housing. Merely by doing so, the conductors, disposed on the obverse and reverse surfaces of the flat plate portion, can be held respectively by the electrical connection portions of the connection terminals, received in the terminal receiving chamber, in a grasped manner, and therefore are electrically connected thereto.

Therefore, it is not necessary to bond a reinforcing plate to the connection end portion of the flat circuit member, and the efficiency of the assembling operation is enhanced. And besides, the connection end portion of the flat circuit member is held on the flat plate portion of the holder in a folded-back manner, and therefore can deal with a pulling force acting on the flat circuit member, so that the connection end portion is prevented from withdrawal.

Furthermore, the conductors on the connection end portion, held on the obverse and reverse surfaces of the flat plate portion of the holder in a folded-back manner, are electrically connected respectively to the electrical connection portions of the connection terminals in a grasped manner, and therefore each conductor contacts the associated connection terminal at two regions, so that the positive electrical connection can be achieved.

When the holder is fitted into the holder casing, the flat plate portion of the holder, having the conducting portion provisionally held on the obverse and reverse surfaces thereof, is passed through the insertion hole formed in the holder casing, and therefore the conducting portion, disposed in contiguous relation to the obverse and reverse surfaces of the flat plate portion, is drawn through the peripheral edge of the insertion hole in a direction away from the folded-back portion toward the proximal end.

Therefore, even if the conducting portion of the flat circuit member should be disposed slightly off the surface of the flat plate portion of the holder, the conducting portion is drawn through the peripheral edge of the insertion hole, and therefore is brought into intimate contact with the obverse and reverse surfaces of the flat plate portion.

Preferably, that portion of the flat circuit member, disposed adjacent to the folded-back portion of the flat circuit member provisionally held on the obverse and reverse surfaces of the flat plate portion, is held between the holder and the holder casing in a bent manner.

In this case, even when a pulling force is applied to the flat circuit member, this tension is positively prevented from acting on that portion of the flat circuit member electrically connected to the connection terminals, so that the stable electrical connection performance can be achieved.

DETAILED DESCRIPTION OF PREFERRED EMBODIMENT

One preferred embodiment of a connector structure of the invention will be described in detail with reference to the drawings.

Figure 1:
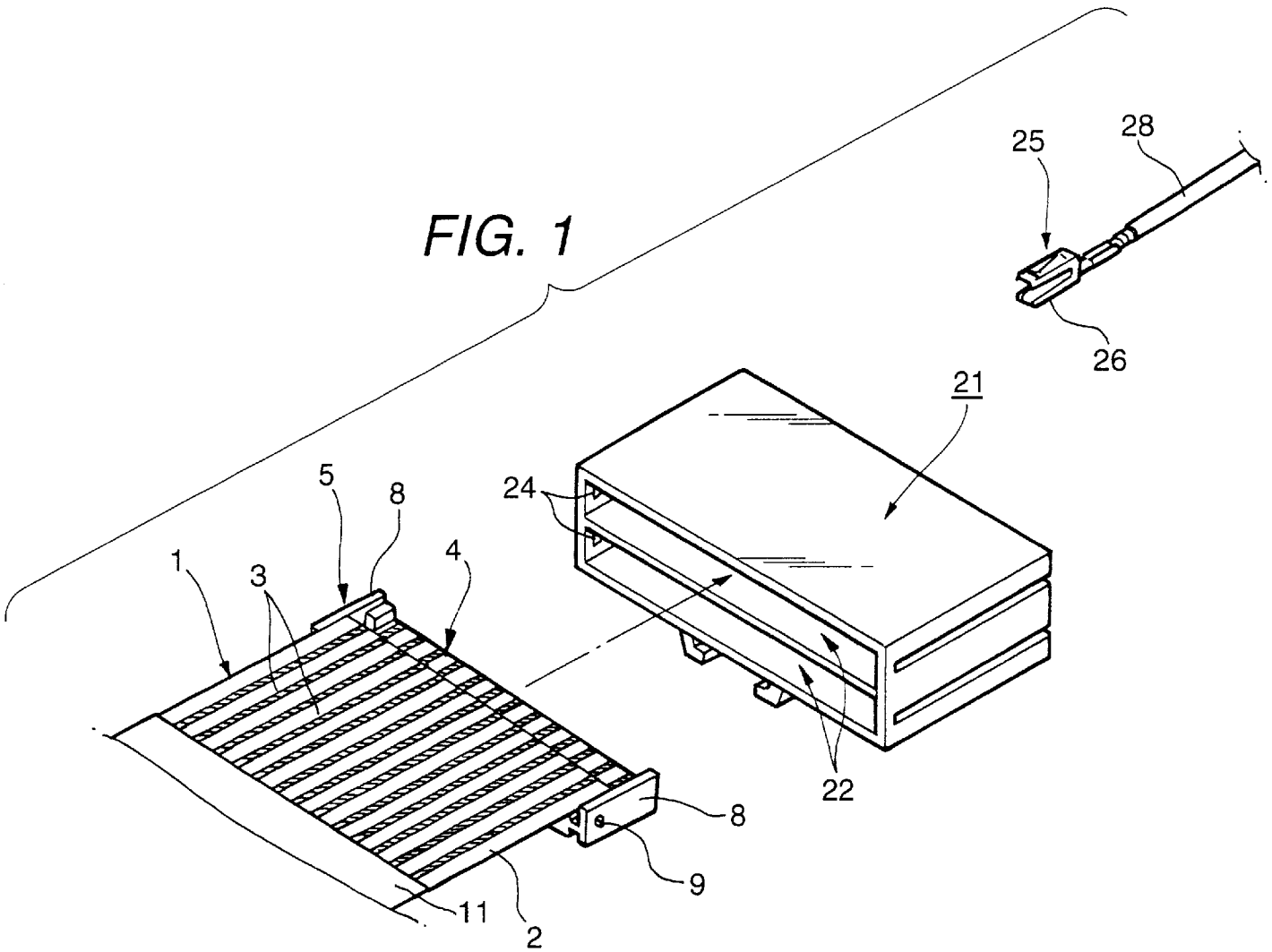
FIG. 1 is an exploded, perspective view of a connector having a first embodiment of a connector structure of the invention.
Figure 2:
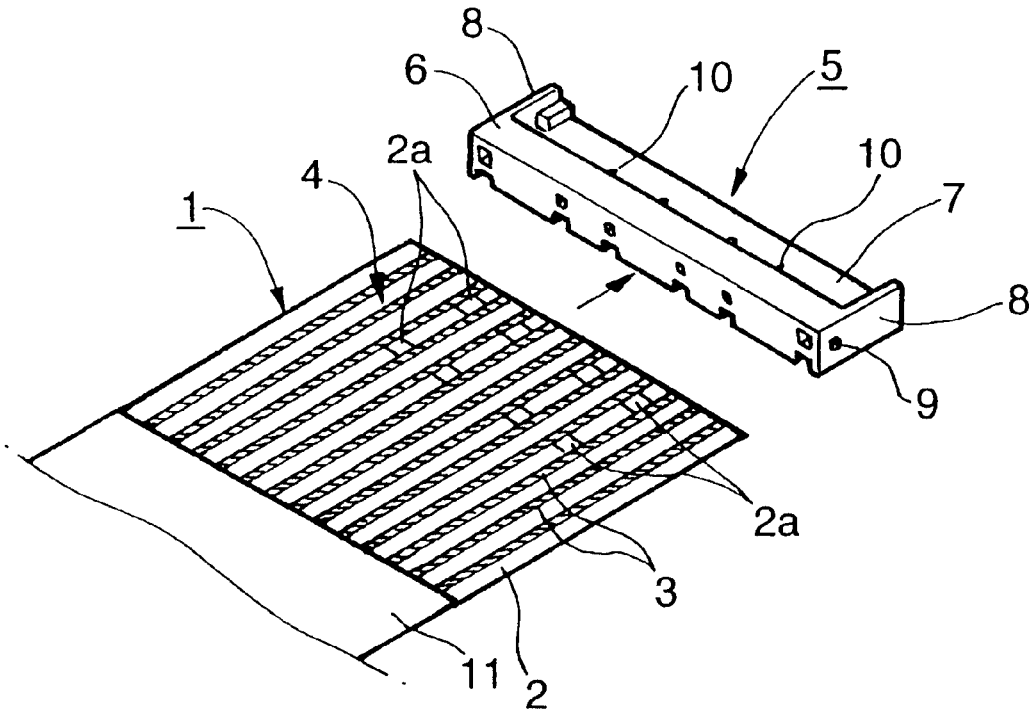
FIG. 2 is an exploded, perspective view showing a holder and a flat circuit member shown in FIG. 1.
Figure 3:
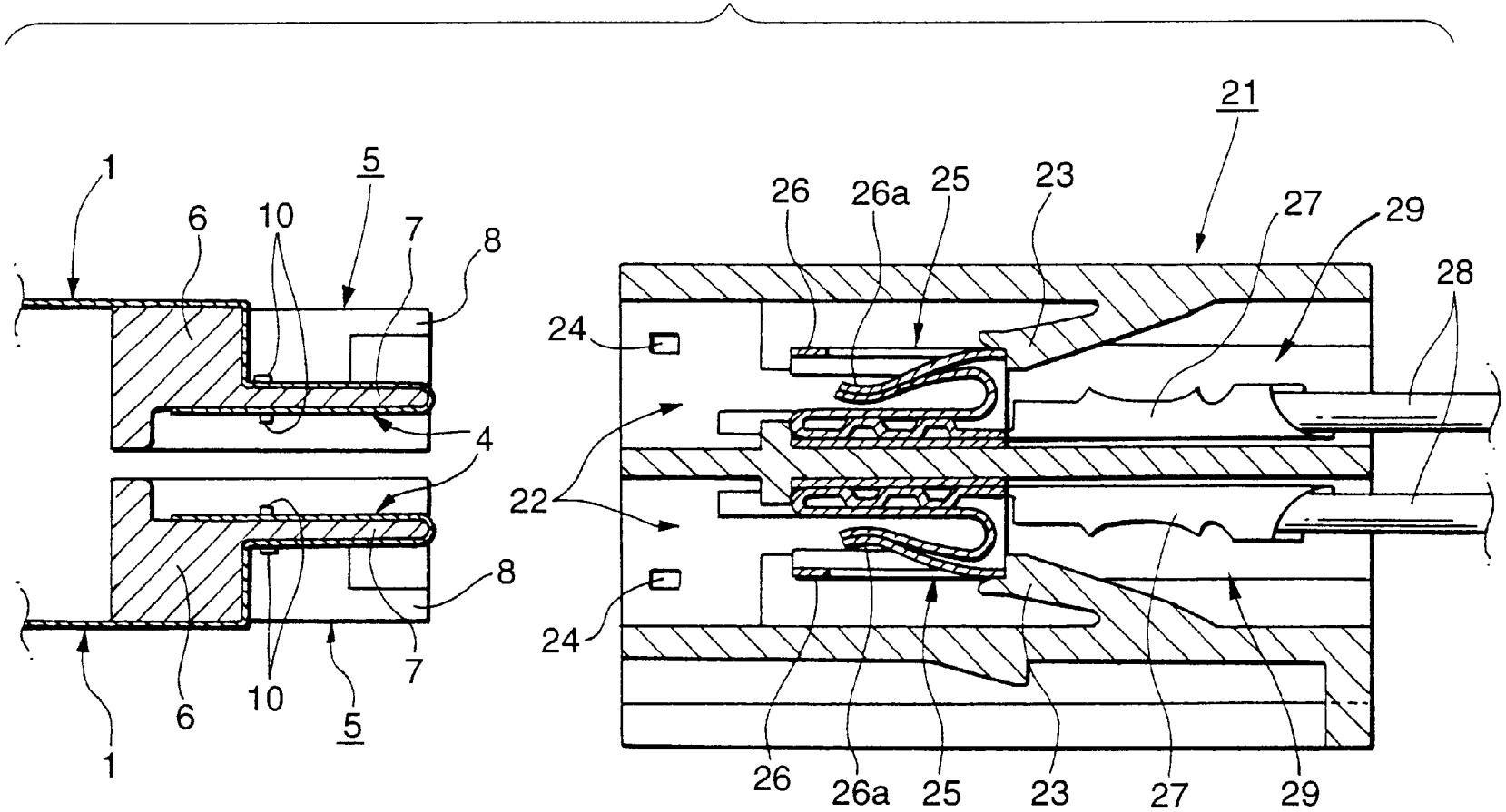
FIG. 3 is a vertical cross-sectional view showing a condition before the holders are fitted into a connector housing shown in FIG. 1.
Figure 4:
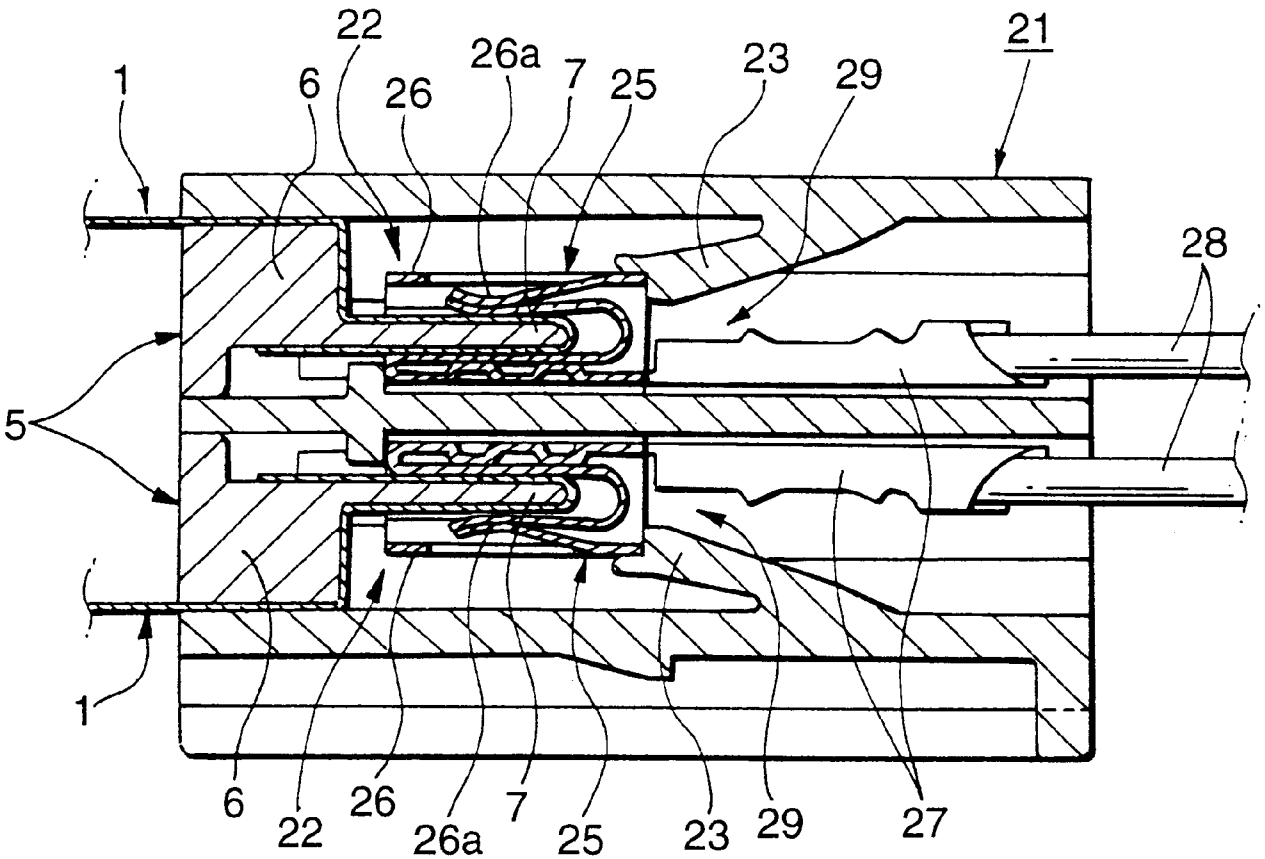
FIG. 4 is a vertical cross-sectional view showing a condition in which the holders, shown in FIG. 3, are completely fitted into the connector housing.

FIGS. 1 to 4 show the first embodiment of the connector structure of the invention. FIG. 1 is an exploded, perspective view of a connector. FIG. 2 is an exploded, perspective view showing a holder and a flat circuit member shown in FIG. 1. FIG. 3 is a vertical cross-sectional view showing a condition before the holders are fitted into a connector housing shown in FIG. 1. FIG. 4 is a vertical cross-sectional view showing a condition in which the holders, shown in FIG. 3, are completely fitted into the connector housing.

As shown in FIG. 1, the connector structure of this first embodiment includes: the connector housing 21, in which a plurality of connection terminals 25 (only one of which is shown in FIG. 1) are inserted in a retained condition; flexible printed circuit boards (hereinafter referred to as "FPC") 1 each formed by printing conductors 3 on an insulating film 2; and the holders 5 which hold connection end portions of the FPCs 1 (each having the parallel conductors 3 arranged thereon at predetermined intervals), and can be fitted into the connector housing 21.

As shown in FIGS. 1 and 3, the connector housing 21 is molded of an insulative resin material, and has a generally rectangular shape. This connector housing 21 has terminal receiving chambers 29 for respectively receiving the plurality of connection terminals 25 inserted from a rear side thereof, and the connector housing 21 also has upper and lower openings 22 and 22 which are formed in the front side thereof, and communicate with the associated terminal receiving chambers 29. Namely, an internal space of a rear end portion of the connector housing 21 is divided into the plurality of terminal receiving chambers 29 by partition walls.

As shown in FIG. 3, the connection terminal 25 includes: a wire press-holding portion 27, press-connected to one end of a wire 28 connected to other equipment; and an electrical connection portion 26 having a press-contact piece 26*a* disposed in a generally U-shaped slot. When the connection terminal 25 is inserted into the terminal receiving chamber 29 in the connector housing 21, this terminal 25 is retained by an elastic lance 23, and therefore is fixed within the connector housing 21.

As shown in FIG. 2, in the FPC 1, the plurality of conductors 3, forming a predetermined circuit, are printed on the insulating film 2. The surface of the FPC 1 is covered with an insulating sheet 11. A conducting portion 4 is formed at the connection end portion of the FPC 1 to be connected to the electrical connection portions 26 of the connection terminals 25, and the parallel conductors 3 are arranged at the predetermined intervals on this conducting portion 4. A plurality of mounting holes 2*a* (for positioning purposes) for respectively passing fixing pins 10 on the holder 5 (described later) therethrough are formed through the insulating film 2 at the conducting portion 4, each of the mounting holes 2*a* being disposed at that portion of the conducting portion 4 lying between the adjacent conductors 3.

As shown in FIGS. 2 and 3, the holder 5 has a generally rectangular shape, and includes a base portion 6 for fitting into the opening 22 in the connector housing 21, a thin flat plate portion 7 extending from the base portion 6 in stepped relation to upper and lower surfaces of the base portion 6, and opposite side walls 8 formed respectively at opposite sides of the flat plate portion 7.

Retaining projections 9 are formed on opposite side surfaces of the base portion 6, respectively. These retaining projections 9 can be engaged respectively in engagement recesses 24, formed respectively in opposed inner side surfaces of the opening 22 in the connector housing 21, thereby fixing the holder 5 in the opening 22 in a locked condition.

As shown in FIG. 3, the plurality of fixing pins 10 are formed on each of upper and lower surface of the flat plate portion 7 at a proximal end portion thereof, and these fixing pins 10 pass respectively through the associated mounting holes 2*a* to position the conducting portion 4 of the FPC 1 relative to the holder 5.

Next, the procedure of connecting the conducting portion 4 of the FPC 1 to the connection terminals 25 through the connector housing 21 and the holder 5 will be described.

First, the conducting portion 4 of the FPC 1, at which the conductors 3 are exposed, is extended or wound around the flat plate portion 7 of the holder 5 in a folded-back manner to be held in contiguous relation thereto, with the fixing pins 10 passed respectively through the mounting holes 2*a*, so that the conducting portion 4 is provisionally held on the flat plate portion 7, as shown in FIGS. 2 and 3.

In this condition, the opposite side walls 8, formed respectively at the opposite sides of the flat plate portion 7, protect the conductors 3 arranged on the obverse and reverse (upper and lower) surfaces of the flat plate portion 7, and even if the holder 5 is dropped, for example, during the connector assembling operation, an external force is prevented from acting directly on the exposed conductors 3. With respect to a wrenching action, when fitting or inserting the holder 5 into the connector housing 21, the opposite side walls 8 also serve to guide the conducting portion 4 so that an excessive external force will not act on the conducting portion 4, and therefore the stable connection between the conducting portion 4 and the connection terminals 25 can be achieved.

Each connection terminal 25, having one end of the wire 28 press-connected to its wire press-holding portion 27, is inserted into the terminal receiving chamber 29 from the rear side of the connector housing 21, and is fixed in the connector housing 21 by the elastic lance 23.

Then, when the holder 5, provisionally holding the conducting portion 4 of the FPC 1, is fitted into the opening 22 from the front side of the connector housing 21. The conductors 3, arranged on the observe and reverse surfaces of the flat plate portion 7, are held respectively by the electrical connection portions 26 of the connection terminals 25, received respectively in the terminal receiving chambers 29 in the connector housing 21. Therefore, the conductors 3 are electrically connected to these connection terminals 25, respectively, as shown in FIG. 4.

Namely, the electrical connection portion 26 has the generally U-shaped slot, capable of receiving the flat plate portion 7 provisionally holding the folded-back conducting portion 4 of the FPC 1, and also has the press-contact piece 26*a* provided in this slot. The electrical connection portion 26 can hold the flat plate portion 7 from the opposite sides (obverse and reverse surfaces) thereof in a press-contacted manner.

When the holder 5 is fitted in the opening 22, the retaining projection 9 are engaged respectively in the engagement recesses 24 to fix the holder 5 in a locked condition. The dimension of the base portion 6 of the holder 5 in the direction of the height is smaller than the dimension of the opening 22 in the direction of the height by an amount generally equal to the thickness of the FPC 1 so that the base portion 6 can be fitted into the opening 22, with the conducting portion 4 disposed in contiguous relation thereto.

Figure 9:
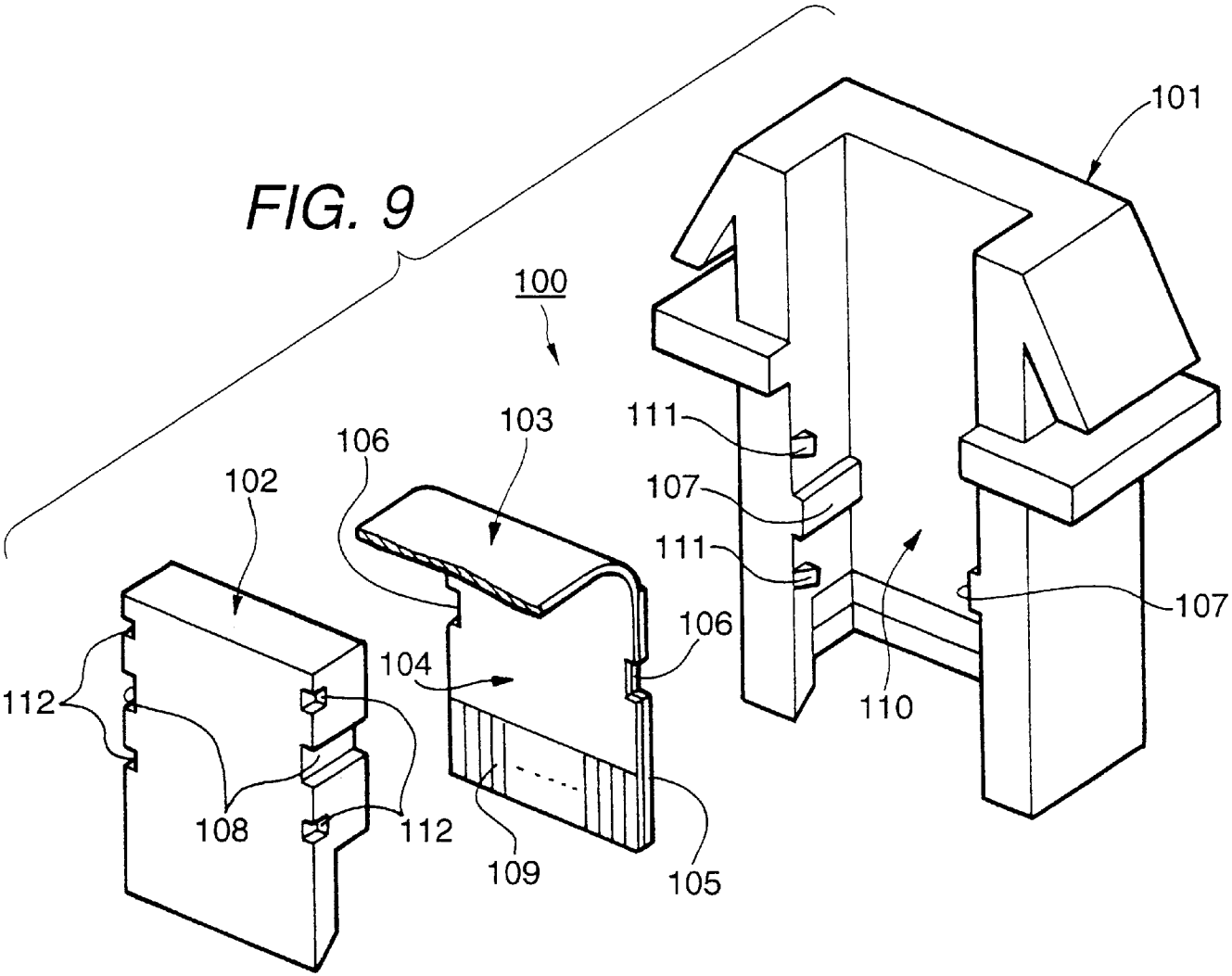
FIG. 9 is an exploded, perspective view of a connector having a conventional connector structure.

Therefore, a reinforcing plate as required in the conventional cable holder 100 of FIG. 9 does not need to be bonded to the conducting portion 4 of the FPC 1, and the efficiency of the assembling operation is enhanced.

The conducting portion 4 of the FPC 1 is held on the flat plate portion 7 of the holder 5 in a folded-back condition, and therefore can deal with a pulling force acting on the FPC 1, so that the conducting portion 4 is prevented from withdrawal. And besides, it is not necessary to form notches respectively in the opposite side edges of the cable as in the conventional cable holder 100 of FIG. 9. Therefore there is not encountered a situation in which the conductors 3 can not be provided at the opposite side portions of the conducting portion 4 of the FPC 1, and therefore the percentage of utilization of the insulating film 2 will not be lowered.

The conductors 3 on the conducting portion 4, held on the obverse and reverse surfaces of the flat plate portion 7 of the holder 5 in a folded-back condition, are electrically connected respectively to the electrical connection portions 26 of the connection terminals 25 in a grasped manner. Therefore, each conductor 3 contacts the associated connection terminal 25 at two regions, so that the positive electrical connection can be achieved.

Figure 5:
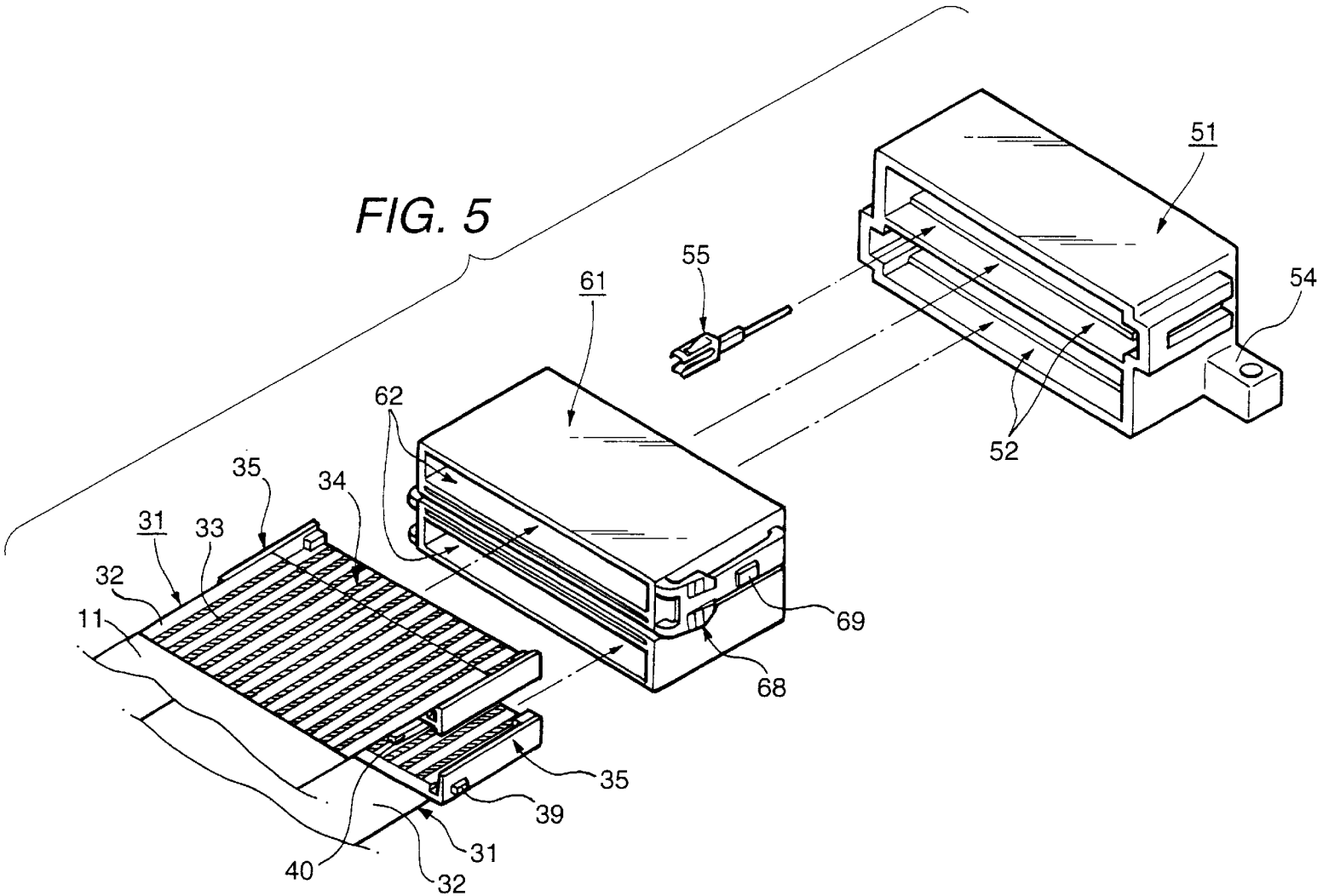
FIG. 5 is an exploded, perspective view of a connector having a second embodiment of a connector structure of the invention.
Figure 6:
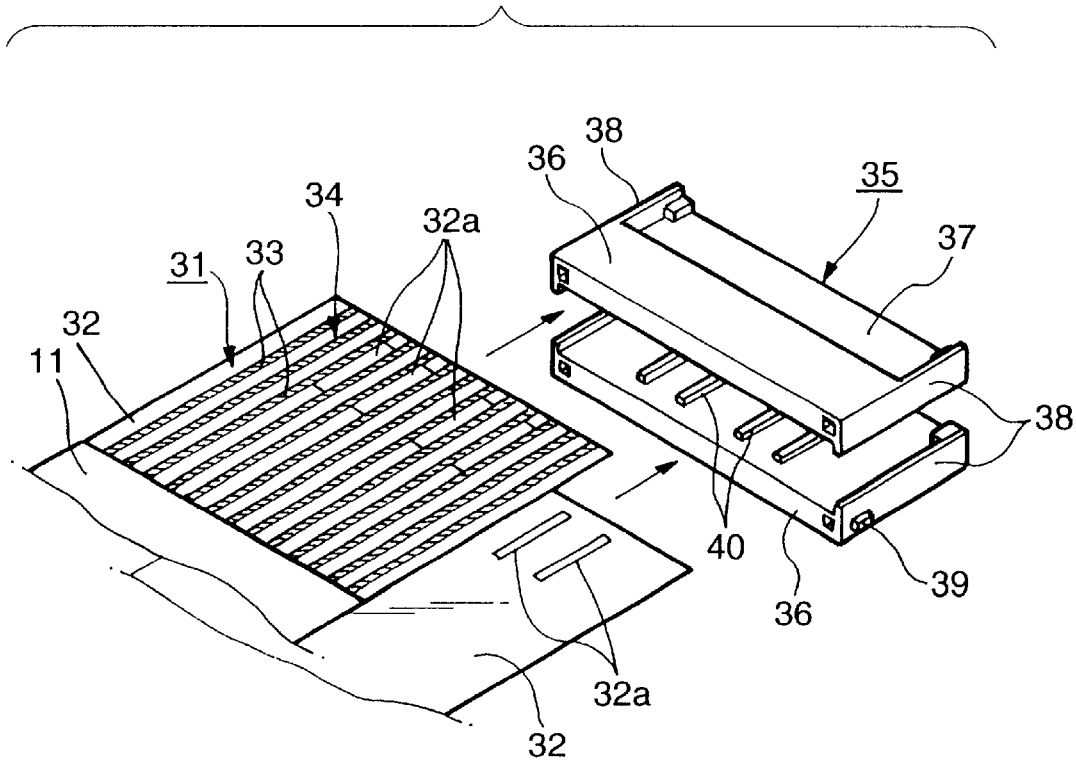
FIG. 6 is an exploded, perspective view showing holders and flat circuit members shown in FIG. 5.
Figure 7:
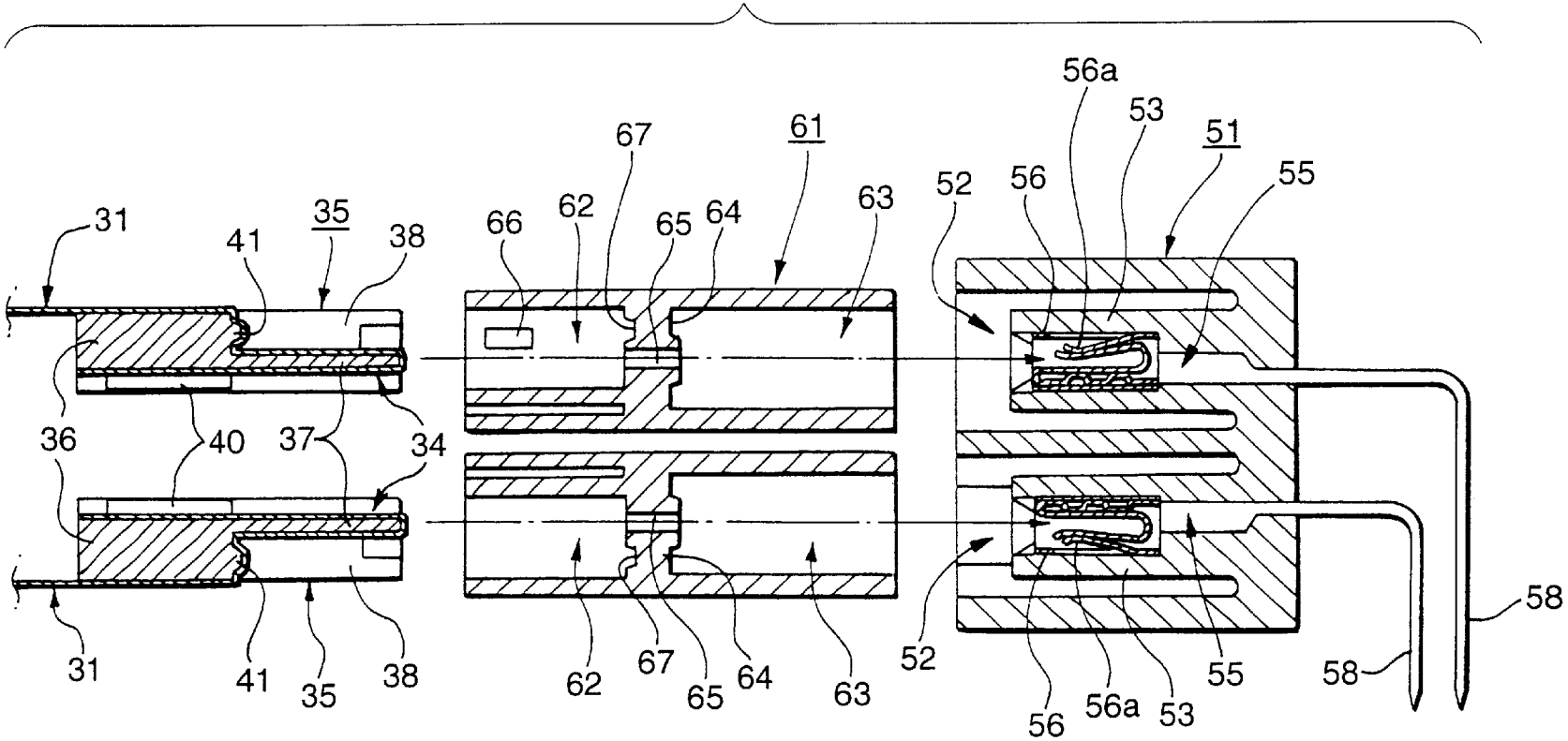
FIG. 7 is a vertical cross-sectional view showing a condition before the holders and holder casings, shown in FIG. 5, are fitted into a connector housing.
Figure 8:
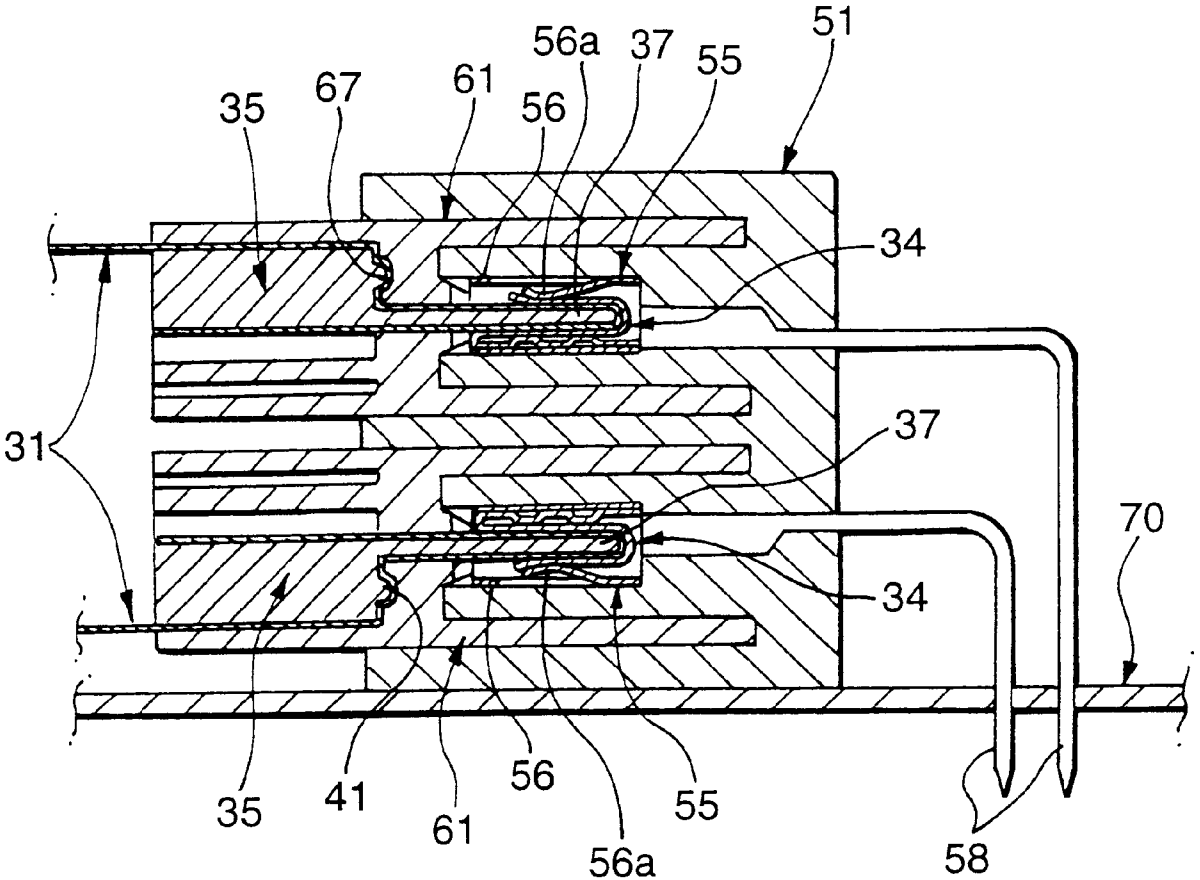
FIG. 8 is a vertical cross-sectional view showing a condition in which the holders and holder casings, shown in FIG. 7, are completely fitted into the connector housing.

FIGS. 5 to 8 show a second embodiment of a connector structure of the invention. FIG. 5 is an exploded, perspective view of a connector. FIG. 6 is an exploded, perspective view showing holders and flat circuit members shown in FIG. 5. FIG. 7 is a vertical cross-sectional view showing a condition before the holders and holder casings, shown in FIG. 5, are fitted into a connector housing. FIG. 8 is a vertical cross-sectional view showing a condition in which the holders and holder casings, shown in FIG. 7, are completely fitted into the connector housing.

As shown in FIG. 5, the connector structure of this second embodiment includes: a connector housing 51, in which a plurality of connection terminals 55 (only one of which is shown in FIG. 5) are inserted in a retained condition; a holder casings 61 which can be removably inserted into the connector housing 51; flexible printed circuit boards (hereinafter referred to as "FPC") 31 each formed by printing conductors 33 on an insulating film 32; and holders 35 which hold connection end portions of the FPCs 31 (each having the parallel conductors 33 arranged thereon at predetermined intervals), and can be fitted respectively into the holder casings 61.

As shown in FIGS. 5 and 7, the connector housing 51 is molded of an insulative resin material, and has a generally rectangular shape. This connector housing 51 includes male connector portions 53 each having terminal receiving chambers for respectively receiving the plurality of connection terminals 55 inserted from a front side thereof, and the connector housing 51 also has upper and lower openings 52 and 52 which are formed respectively at the front sides of the male connector portions 53. The connection terminals 55 are press-fitted in the terminal receiving chambers of the male connector portions 53, respectively. Flanges 54 (see FIG. 5) are formed respectively on opposite outer side surfaces of the connector housing 51, and the connector housing 51 is fixedly secured to a printed circuit board 70 by screws passing respectively through these flanges 54.

As shown in FIG. 7, the connection terminal 55 includes an electrical connection portion 56, having a press-contact piece **56*a* disposed in a generally U-shaped slot, and a pin terminal 58. The connection terminal 55 is first press-fitted into the terminal receiving chamber in the male connector portion 53, and then the pin terminal 58, projecting from the rear side of the connector housing 51, is suitably bent perpendicularly, and passes through a through hole in the printed circuit board 70 so as to be connected to an associated circuit (see FIG. 8**).

As shown in FIG. 6, in the FPC 31, the plurality of conductors 33, forming a predetermined circuit, are printed on the insulating film 32, and the surface of the FPC 31 is covered with an insulating sheet 11. A conducting portion 34 is formed at the connection end portion of the FPC 31 to be connected to the electrical connection portions 56 of the connection terminals 55, and the parallel conductors 33 are arranged at the predetermined intervals on this conducting portion 34. A plurality of mounting slots **32*a* (for positioning purposes) for respectively passing fixing ribs 40 on the holder 35 (described later) therethrough are formed through the insulating film 32 at the conducting portion 34, each of the mounting slots 32*a* being disposed at that portion of the conducting portion 34 lying between the adjacent conductors 33**.

As shown in FIGS. 6 and 7, the holder 35 has a generally rectangular shape, and includes a base portion 36 for fitting into a holder receiving portion 62 of the holder casing 61, a thin flat plate portion 37 extending from the base portion 36 in stepped relation to upper and lower surfaces of the base portion 36, and opposite side walls 38 formed respectively at opposite sides of the flat plate portion 37.

A retaining projection 39 is formed on one side surface of the base portion 36, and this retaining projection 39 can be engaged in an engagement recess 66, formed in one inner side surface of the holder receiving portion 62 of the holder casing 61, thereby fixing the holder 35 in the holder receiving portion 62 in a locked condition.

As shown in FIGS. 6 and 7, the plurality of fixing ribs 40 are formed on the reverse (lower) surface of the flat plate portion 37 at a proximal end portion thereof, and these fixing ribs 40 pass respectively through the associated mounting slots **32*a* to position the conducting portion 34 of the FPC 31 relative to the holder 35**.

As shown in FIGS. 5 and 7, the holder casing 61 has a rectangular body molded of an insulating resin material, and an internal space of this holder casing 61 is divided by a partition wall 64 into the holder receiving portion 62 for receiving the holder 35 and a female connector portion 63 for receiving the male connector portion 53. An insertion hole 65 is formed through the partition wall 64. The flat plate portion 37 of the holder 35, having the conducting portion 34 of the FPC 31 provisionally held on the obverse and reverse surfaces thereof, is passed through this insertion hole 65. This insertion hole 65 has a cross-sectional shape substantially equal to the transverse cross-sectional shape of the flat plate portion 37.

An elongate projection 41 is formed on the base portion 36, and extends in the direction of the width thereof. A groove 67, corresponding to this elongate projection 41, is formed in that surface of the partition wall 64 of the holder receiving portion 64 to be opposed to the base portion 36, and extends in the direction of the width thereof. When the holder 35 is fitted into the holder receiving portion 62, that portion of the conducting portion 34 of the FPC 31, disposed adjacent to that portion of the conducting portion 34 provisionally held on the obverse and reverse surfaces of the flat plate portion 37, is held between the base portion 36 of the holder 35 and the partition wall 64 of the holder casing 61 in a bent manner.

A lock arm 68, having a retaining projection 69, is formed on one outer side surface of the holder casing 61. The retaining projection 69 is engaged in an engagement recess (not shown) formed in an inner side surface of the opening 52 in the connector housing 51, thereby releasably locking the holder casing 61 in an opening 52.

Next, the procedure of connecting the conducting portion 34 of the FPC 31 to the connection terminals 55 through the holder 35 and the holder casing 61 will be described.

First, the conducting portion 34 of the FPC 31, at which the conductors 33 are exposed, is extended or wound around the flat plate portion 37 of the holder 35 in a folded-back manner to be held in contiguous relation thereto, with the fixing ribs 40 passed respectively through the mounting slots 32*a*, so that the conducting portion 34 is provisionally held on the flat plate portion 37, as shown in FIGS. 6 and 7.

In this condition, the opposite side walls 38, formed respectively at the opposite sides of the flat plate portion 37, protect the conductors 33 arranged on the obverse and reverse (upper and lower) surfaces of the flat plate portion 37, and even if the holder 35 is dropped, for example, during the connector assembling operation, an external force is prevented from acting directly on the exposed conductors 33. With respect to a wrenching action, when inserting the holder 35 into the holder casing 61, the opposite side walls 38 also serve to guide the conducting portion 34 so that an excessive external force will not act on the conducting portion 34, and therefore the stable connection between the conducting portion 34 and the connection terminals 55 can be achieved.

With respect to each connection terminal 55 press-fitted in the terminal receiving chamber in the male connector portion 53, the pin terminal 58, projecting from the rear end of the connector housing 51, is suitably bent perpendicularly. The connector housing 51 is fixed to the printed circuit board 70. And the pin terminal 58 passes through the through hole in the printed circuit board 70, and is soldered thereto.

Then, the holder 35, provisionally holding the conducting portion 34 of the FPC 31, is fitted into the holder receiving portion 62 in the holder casing 61. At this time, the retaining projection 39 on the holder 35 is retainingly engaged in the engagement recess 66 in the holder casing 61, thereby fixing the holder 35 in the holder receiving portion 62 in a locked condition.

Then, the holder casing 61 is inserted into the opening 52 in the connector housing 51, so that the female connector portion 63 of the holder casing 61 is fitted on the male connector portion 53 of the connector housing 51. As a result, the conductors 33, arranged on the observe and reverse surfaces of the flat plate portion 37 of the holder 35, are held respectively by the electrical connection portions 56 of the connection terminals 55, received respectively in the terminal receiving chambers in the male connector portion 53. Therefore the conductors 33 are electrically connected to these connection terminals 55, respectively, as shown in FIG. 8.

Namely, the electrical connection portion 56 has the generally U-shaped slot, capable of receiving the flat plate portion 37 provisionally holding the folded-back conducting portion 34 of the FPC 31, and also has the press-contact piece 56*a* provided in this slot. The electrical connection portion 56 can grasp the flat plate portion 37 from the opposite sides (obverse and reverse surfaces) thereof in a press-contacted manner.

The holder casing 61, fitted in the opening 52 in the connector housing 51, is fixed in a locked condition by the lock arm 68.

The base portion 36 of the holder 35 is so formed that this base portion 36 can be fitted into the holder receiving portion 62, with the conducting portion 34 of the FPC 31 held in contiguous relation thereto.

Therefore, in the connector structure of this second embodiment, also, a reinforcing plate as required in the conventional cable holder 100 of FIG. 9 does not need to be bonded to the conducting portion of the FPC as in the connector structure of the first embodiment, and the efficiency of the assembling operation is enhanced.

The conducting portion 34 of the FPC 31 is held on the flat plate portion 37 of the holder 35 in a folded-back condition, and therefore can deal with a pulling force acting on the FPC 31, so that the conducting portion 34 is prevented from withdrawal. And besides, it is not necessary to form notches respectively in the opposite side edges of the cable as in the conventional cable holder 100 of FIG. 9, and therefore there is not encountered a situation in which the conductors 33 can not be provided at the opposite side portions of the conducting portion 34 of the FPC 31, and therefore the percentage of utilization of the insulating film 32 will not be lowered.

The conductors 33 on the conducting portion 34, held on the obverse and reverse surfaces of the flat plate portion 37 of the holder 35 in a folded-back condition, are electrically connected respectively to the electrical connection portions 56 of the connection terminals 55 in a grasped manner, and therefore each conductor 33 contacts the associated connection terminal 55 at two regions, so that the positive electrical connection can be achieved.

In the second embodiment, when the holder 35 is fitted into the holder casing 61, the flat plate portion 37 of the holder 35, having the conducting portion 34 provisionally held on the obverse and reverse surfaces thereof, is passed through the insertion hole 65. Therefore the conducting portion 34, disposed in contiguous relation to the obverse and reverse surfaces of the flat plate portion 37, is drawn through the peripheral edge of the insertion hole 65 in a direction away from the folded-back portion toward the proximal end.

Therefore, even if the conducting portion 34 of the FPC 1 should be disposed slightly off the surface of the flat plate portion 37 of the holder 35, the conducting portion 34 is drawn through the peripheral edge of the insertion hole 65, and therefore is brought into intimate contact with the obverse and reverse surfaces of the flat plate portion 37.

When the holder 35 is fitted into the holder receiving portion 62, that portion of the conducting portion 34 of the FPC 31, disposed adjacent to that portion of the conducting portion 34 provisionally held on the obverse and reverse surfaces of the flat plate portion 37, is held between the base portion 36 of the holder 35 and the partition wall 64 of the holder casing 61 in a bent manner through the elongate projection 41 on the base portion 36 and the groove 67 in the partition wall 64.

Therefore, even when a pulling force is applied to the FPC 31, this tension is positively prevented from acting on that portion of the FPC electrically connected to the connection terminals 56, so that the stable electrical connection performance can be achieved.

The connector housing, the connection terminals, the flat circuit member, the holder, the holder casing and so on of the connector structures of the invention are not limited to those in the above embodiments, and suitable modifications can be made within the scope of the invention.

For example, although the connector housing 21 of the first embodiment receives the connection terminals 25 each press-connected to one end of the wire 28, this connector housing can be of the type which receive the connection terminals 55 (each having the pin terminal 58), and is fixed to the printed circuit board 70 as is the case with the connector housing 51 of the second embodiment. Similarly, the connector housing 51 of the second embodiment can be of the type which receives the connection terminals 25, each press-connected to one end of the wire 28, as is the case with the connector housing 21 of the first embodiment.

In the above embodiments, although the FPC is used as the flat circuit member, the present invention can be applied to any other suitable flexible flat circuit member such as an FFC and a ribbon wire.

In the connector structure of the invention, the connection end portion of the flat circuit member, at which the conductors are exposed, is provisionally held on the flat plate portion of the holder in a folded-back manner. Then the holder is fitted into the connector housing, and merely by doing so, the conductors disposed on the obverse and reverse surfaces of the flat plate portion can be held respectively by the electrical connection portions of the connection terminals, received in the terminal receiving chamber, in a grasped manner, and therefore are electrically connected thereto.

Therefore, it is not necessary to bond a reinforcing plate to the connection end portion of the flat circuit member, and the efficiency of the assembling operation is enhanced. The connection end portion of the flat circuit member is held on the flat plate portion of the holder in a folded-back manner, and therefore can deal with a pulling force acting on the flat circuit member, so that the connection end portion is prevented from withdrawal.

Furthermore, the conductors on the connection end portion, held on the obverse and reverse surfaces of the flat plate portion of the holder in a folded-back manner, are electrically connected respectively to the electrical connection portions of the connection terminals in a grasped manner, and therefore each conductor contacts the associated connection terminal at two regions, so that the positive electrical connection can be achieved.

Therefore, there can be provided the connector structure in which the connection end portion of the flexible flat circuit member is easily formed into the terminal so as to be connected to the connector, and besides even when the connection end portion is formed into the terminal, the percentage of utilization of the flat circuit member is prevented from being lowered, and the stable connection performance can be obtained.

What is claimed is:

1. A connector structure for electrically connecting at least one conductor exposed to a connection end portion of a flexible flat circuit member, said connector structure comprising;

a connector housing forming at least one terminal receiving chamber;

at least one connection terminal accommodated in said at least one terminal receiving chamber, respectively, each of said at least one connection terminal forming an electrical connection portion; and a holder fitted into said connector housing and forming a flat plate portion, obverse and reverse surfaces of said flat plate portion to hold said connection end portion without bonding in a folded-back manner so that said at least one conductor is disposed on said obverse and reverse surfaces, the holder having at least one elongate projection or groove formed thereon to provide additional retaining force through engagement of the projection or groove and the flexible flat circuit member in use, such that the flexible flat circuit member covers the projection or groove with a portion of the flexible flat circuit member which does not directly contact said connection terminal, wherein said connector housing encloses a holder receiving portion which has at least one elongate projection or groove, and which respectively mates with said groove or projection of said holder so as to hold the flexible flat circuit member, and wherein said at least one electrical connection portion is adapted to hold respectively said at least one conductor disposed on said obverse and reverse surfaces so that said at least one conductor is electrically connected to said at least one connection terminal.

2. A connector structure according to claim 1, wherein number of said conductor is two or more, said at least two conductors are provided on said connection end portion at predetermined intervals in parallel relation to one another.

3. A connector structure according to claim 1, wherein said connector housing forms an opening communicated with said at least one terminal receiving chamber, said holder is inserted into and fitted into said opening in a inserting direction.

4. A connector structure according to claim 3, wherein said flat plate portion is extended in said insertion direction.

5. A connector structure according to claim 1, wherein fixing pins are formed on each of said obverse and reverse surfaces to position said connection end portion with respect to said holder.

6. A connector structure for electrically connecting at least one conductor exposed to a connection end portion of a flexible flat circuit member, said connector structure comprising:

a connector housing forming at least one terminal receiving chamber;

at least one connection terminal accommodated in said at least one terminal receiving chamber, respectively, each of said at least one connection terminal forming an electrical connection portion;

a holder casing insertable into said connector housing and forming an insertion hole;

a holder fitted into said holder casing and forming a flat plate portion passed through said insertion hole, obverse and reverse surfaces of said flat plate portion to hold said connection end portion in a folded-back manner without bonding so that said at least one conductor is disposed on said obverse and reverse surfaces;

wherein said at least one electrical connection portion is adapted to hold respectively said at least one conductor disposed on said obverse and reverse surfaces of said flat plate portion passed through said insertion hole so that said at least one conductor is electrically connected to said at least one connection terminal; and wherein an elongate projection is provided at one of said holder and said holder casing, a groove opposite to said elongate projection is provided at the other of said holder and said holder casing, and said elongate projection cooperates with said groove to hold and bend a portion of said flexible flat circuit member.

7. A connector structure according to claim 6, wherein said connector a bent portion of said flat circuit member located base side of a portion provisionally held by said obverse and reverse surfaces is held and bent between said holder and said holder casing.

8. A connector structure according to claim 6, wherein number of said conductor is two or more, said at least two conductors are provided on said connection end portion at predetermined intervals in parallel relation to one another.

9. A connector structure according to claim 6, wherein said connector housing forms an opening communicated with said at least one terminal receiving chamber, said holder casing is inserted and fitted into said opening in a inserting direction.

10. A connector structure according to claim 9, wherein said flat plate portion is extend in said insertion direction.

11. A connector structure according to claim 6, wherein fixing pins are formed on each of said obverse and reverse surfaces to position said connection end portion with respect to said holder.

* * * * *